United States Patent [19]

Foley

[11] 4,103,585

[45] Aug. 1, 1978

[54] AMMUNITION FIRING SYSTEM HAVING MEANS FOR ELECTRICALLY SIGNALING PRESENCE OR ABSENCE OF AMMUNITION

[75] Inventor: Nelson D. Foley, Little Rock, Ark.

[73] Assignee: Bei Electronics, Inc., Little Rock, Ark.

[21] Appl. No.: 760,377

[22] Filed: Jan. 18, 1977

[51] Int. Cl.[2] ..... F41F 3/04

[52] U.S. Cl. ..... 89/1.814; 102/215

[58] Field of Search ..... 89/1.814, 1.5 R, 1.5 D, 89/1.55; 102/70.2 R, 70.2 A

[56] References Cited

U.S. PATENT DOCUMENTS 3,675,578 7/1972 Douglas et al. ..... 102/70.2 R

*Primary Examiner*—Stephen C. Bentley

*Attorney, Agent, or Firm*—Burmeister, York, Palmatier, Hamby & Jones

[57] ABSTRACT

The ammunition firing system is especially advantageous for electrically firing military rockets from a multiple tube rocket launcher. The system provides an electrical signal indicating the presence or absence of a rocket ready to be fired in each launching tube. The signal is derived from the firing wire or lead which is also used to fire the rocket. In each rocket, an igniter of low electrical resistance is connected between the firing lead and a common ground. Initially, the firing lead is connected by switching means to a signal source which supplies a signal current of a low energy, insufficient to cause the igniter to fire the ammunition. The system includes indicating means for indicating the presence or absence of the signal current through the igniter, so as thereby to indicate the presence or absence of the rocket in the launching tube. The signal source may include a signal voltage supply and a current limiting resistance to limit the signal current so that it will be incapable of firing the rocket. With this electrical indication from each firing circuit, it is possible to take an inventory electrically of the presence or absence of rockets in the launching tubes of the multiple rocket launcher. When a rocket is to be fired, the switching means may be operated to connect the firing lead of the rocket to a firing voltage source which provides ample energy to the igniter to fire the rocket.

8 Claims, 1 Drawing Figure

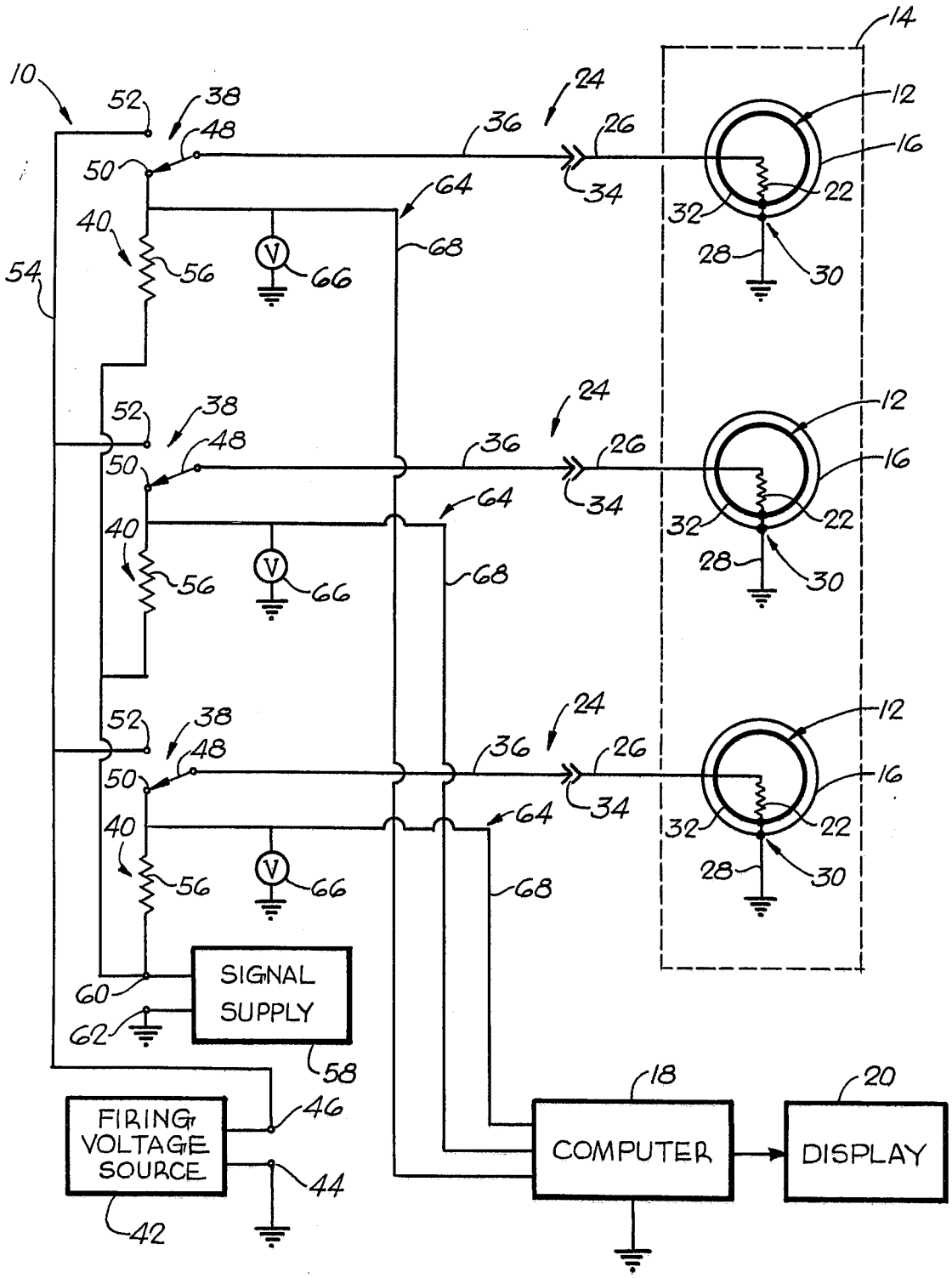
SIGNAL SUPPLY
FIRING VOLTAGE SOURCE
COMPUTER
DISPLAY

AMMUNITION FIRING SYSTEM HAVING MEANS FOR ELECTRICALLY SIGNALING PRESENCE OR ABSENCE OF AMMUNITION

This invention relates to a system for electrically firing military ammunition. The system may be applied to any type of ammunition, but is especially advantageous for firing military rockets from a rocket launcher having a multiplicity of launching tubes. Such launchers are commonly used on military helicopters and other military vehicles.

In one common rocket firing system, each rocket is provided with an electrically operable igniter in the form of a small electrical filament or resistance element which is adapted to be heated by the passage of an electrical firing current through the igniter, the heat being sufficient to fire a primer which ignites the propulsion charge of the rocket. The igniter is connected into a firing circuit which includes a firing wire or lead connected to one side of the igniter, and means for connecting the other side of the igniter to a common ground. The firing lead of each rocket is connected by a suitable connector to the firing control system, whereby a firing current can be supplied to each firing lead under the control of the operator.

One object of the present invention is to provide a new and improved firing system having means for electrically signaling the presence or absence of each rocket or other round of ammunition, ready to be fired electrically. The provision of the electrical signal for each rocket makes it possible to conduct an electrical inventory of the rockets in all of the launching tubes of a multiple tube rocket launcher.

A further object is to provide such a new and improved ammunition firing system which derives each electrical signal from the electrical firing lead of each rocket, so that no modification is required in the rocket or the firing lead.

To accomplish these objects, the present invention preferably provides an ammunition firing system comprising a rocket or other round of ammunition having an electrically operable igniter with a predetermined electrical resistance, a firing circuit connected to the igniter, a firing voltage source, a signal source for supplying a signal current of a low energy insufficient to cause the igniter to fire the ammunition, firing control switching means for initially connecting the firing circuit to the signal source and for subsequently connecting the firing circuit to the firing voltage source, and indicating means connected to the signal source for indicating the presence or absence of a signal current through the igniter to indicate the presence or absence of the round of ammunition, the signal current being absent in the absence of the round of ammunition and also after the firing of the round.

The signal source may include a signal voltage supply and a current limiting resistance or impedance connected in series with the signal voltage supply to limit the signal current to a low value which is insufficient to fire the ammunition. The indicating means may be connected across the firing circuit and may be responsive to the voltage drop due to the flow of the signal current through the igniter. Such voltage drop is much less when the igniter is present than when the igniter is absent from the firing circuit. The firing control switching means may include a switch for alternatively connecting the firing circuit to the signal source or the firing voltage source. The firing circuit may include a firing wire or lead connected to one side of the igniter, and means for connecting the other side of the igniter to a common ground. The firing control switch may be connected between the firing lead and the ungrounded sides of the signal source and the firing voltage source.

Further objects, advantages and features of the present invention will appear from the following description, taken with the accompanying drawing, in which the single FIGURE is a schematic electrical circuit diagram showing the munition firing system to be described as an illustrative embodiment of the present invention.

As just indicated, the drawing illustrates an electrical firing control system 10 which is applicable to any type of electrically fired ammunition, but is illustrated, by way of example, as applied to the firing of a plurality of military rockets 12, adapted to be fired from a rocket launcher 14 having a multiplicity of launching tubes 16, only three of which are shown for simplicity of illustration. In ordinary practice, the rocket launcher 14 may have as many as 24 rocket launching tubes 16, or even more. Rockets of several different types may be carried in the rocket launcher 14, such as armor piercing rockets, anti-personnel rockets, incendiary rockets, and smoke producing rockets. Groups of the launching tubes 16 in different zones of the rocket launcher 14 may be allocated to hold rockets of the various types. The present invention makes it possible to taken an inventory electrically of the presence or absence of rockets, ready to fire, in the launching tubes 16 of the various zones. The inventory may be taken and maintained on a current basis by a small computer 18 having a display 20, indicating the number of rockets of each type which remain in the rocket launcher 14 and are ready to fire. The operator can thus read the display at any time to determine the number of rocket weapons of each type at his disposal. The computer 18 can also be arranged to assist in the firing of any desired number of rockets of each type.

Each rocket or other round of ammunition 12 has an igniter 22 which is in the form of a small electrical filament or resistance heating element, adapted to be heated by the passage of an electrical firing current through the igniter. The heat generated by the igniter 22 ignites the primer charge which in turn ignites the propulsion charge of the rocket 12.

The igniter 22 of each rocket 12 is connected into its own firing circuit 24, illustrated as comprising a firing wire or lead 26 connected to one side of the igniter 22. The other side of the igniter 22 may be connected to a common ground 28 by suitable grounding means 30, which may include a connection between the igniter 22 and the metal shell 32 of the rocket 12, and a grounding clip or the like between the metal shell and the launching tube 16. It will be understood that the launching tube 16 may also be made of metal and may be connected to the common ground 28.

The firing circuit 24 may also include a suitable connector 34, whereby the firing wire or lead 26 is connected to an additional firing lead 36, extending from the rocket launcher 14 to the control location where the operator is situated. The various firing leads 36 for the multiple rockets 12 in the rocket launcher 14 may be combined in a multiconductor cable or wiring harness.

The firing circuit 24 for each rocket 12 is provided with switching means 38 for initially connecting the firing lead 36 to a signal source 40, whereby the presence or absence of the rocket is determined electrically. When it is desired to fire the rocket 12, the switching means 38 may be employed to connect the firing lead 36 to a firing voltage source 42 which provides ample voltage to cause the igniter 22 to fire the rocket 12. As shown, the firing voltage source has grounded and ungrounded output terminals 44 and 46.

As illustrated, each of the switching means 38 takes the form of a two-position switch 48 for connecting the firing lead 36 alternatively to terminals or contacts 50 and 52. The terminal 50 is connected to the signal source 40, while the terminal 52 is connected by the lead 54 to the ungrounded terminal 46 of the firing voltage source. The switch 48 may be either mechanical or electronic in operation. Various other specific switching means may be employed.

As shown, the signal source 40 comprises a current limiting resistance or other impedance 56 connected in series with a signal voltage supply 58. One side of the illustrated resistance 56 is connected to the switch terminal 50, while the other side of the resistance 56 is connected to the ungrounded output terminal 60 of the signal voltage supply 58, the other output terminal 62 being grounded.

The signal voltage supply 58 may produce signals of various types, such as direct current, alternating current, or pulses. The current limiting resistance 56 limits the signal current to a low value, compared with the normal firing current, so that the signal has a low energy, insufficient to cause the igniter 22 to fire the rocket 12. The nature of the impedance 56, whether resistive or reactive, depends upon the nature of the signals. The illustrated resistance 56 should ordinarily have a resistance value which is considerably greater than the resistance value of the igniter 22, so that the magnitude of the signal current is determined almost entirely by the resistance value of the current limiting resistance 56.

Each firing circuit 24 also includes indicating means 64 for determining and indicating the presence or absence of a signal current through the igniter 22. The indicating means 64 may be connected to the firing lead 36 and may be responsive to the voltage drop across the firing circuit. When the igniter 22 is present in the firing circuit 24, the voltage drop is low, because of the low signal current and the low resistance value of the igniter 22. When the igniter 22 is absent, due to the absence of a rocket, or the previous firing of the rocket 12, the voltage drop between the firing lead 36 and ground is relatively high and is substantially equal to the full signal voltage, due to the lack of any signal current to cause a voltage drop across the current limiting resistance. When the igniter 22 is present, the signal current causes a voltage drop across the resistance 56 which is nearly as great as the full signal voltage, leaving only a small voltage drop to be produced across the igniter 22.

The signal voltage drop across the firing circuit 24 may be indicated or determined by any suitable voltage indicator 66, which may be either electronic or electromechanical in operation. Thus, the indicator 66 may include an electromechanical volt meter, an electronic volt meter, or an electronic circuit which produces any suitable type of display, or performs control functions.

As shown, the indicating means 64 also includes a connection 68 to the computer 18, so that the computer can use the signal voltages from the various firing circuits 24 to take an inventory electrically of the presence or absence of the rockets 12 in the various launching tubes 16 of the rocket launcher 14.

Initially, the signal voltage is at a low level on each of the lines 68 running to the computer 18, due to the low voltage drop across the corresponding igniter 22. The computer interprets this low signal voltage as indicating the presence of a rocket 12 in the corresponding launching tube 16. If any rocket is missing or if the firing circuit 24 is open, the full signal voltage, at a higher level, appears on the corresponding lead 68. The computer 18 interprets this higher voltage as indicating the absence of the rocket. When any rocket 12 is fired, the signal voltage on the corresponding line 68 rises to the full value. The computer then interprets this increased signal as indicating that the rocket has been fired. It will be understood that the computer 18 may have memory devices for keeping track of the number of rockets of each type, remaining in the rocket launcher 14.

In summary, the ammunition firing system is especially advantageous for electrically firing military rockets from a multiple tube rocket launcher. The system provides an electrical signal indicating the presence or absence of a rocket ready to be fired in each lauching tube. The signal is derived from the firing wire or lead which is also used to fire the rocket. In each rocket, an igniter of low electrical resistance is connected between the firing lead and a common ground. Initially, the firing lead is connected by switching means to a signal source which supplies a signal current to the igniter, such signal current being of a low energy, insufficient to cause the igniter to fire the ammunition. The system includes indicating means for indicating the presence or absence of the signal current through the igniter, so as thereby to indicate the presence or absence of the rocket in the launching tube. The signal source may include a signal voltage supply and a current limiting resistance or other impedance connected in series with such signal voltage supply to limit the signal current so that it will be incapable of firing the rocket. The indicating means may be connected between the firing lead and ground and may be responsive to the voltage drop across the igniter, due to the signal current. Such voltage drop is substantially less when the igniter is present than when the igniter is absent in the firing circuit. Thus, a normal low voltage drop indicates the presence of a rocket ready to fire in the launching tube. A high voltage drop indicates that the rocket is absent or inoperative, or has already been fired. With this electrical indication from each firing circuit, it is possible to take an inventory electrically of the presence or absence of rockets in the launching tubes of the multiple rocket launcher. When a rocket is to be fired, the switching means may be operated to connect the firing lead of the rocket to a firing voltage source which provides ample energy to the igniter to fire the rocket.

I claim:

1. An ammunition firing system,
comprising a plurality of rounds of ammunition,
each of said rounds having an electrically operable igniter with a predetermined electrical resistance,
a plurality of igniter circuits connected to the respective igniters,
a firing voltage source,
a signal source,
a plurality of switching devices connected to the respective igniter circuits, each of said switching devices being independently operable between a signal condition and a firing condition, and a plurality of signal circuits connected between said signal source and the respective switching devices, each switching device including means operative in said signal condition for connecting the corresponding igniter circuit to the corresponding signal circuit, each signal circuit including a current limiting impedance for limiting the signal current supplied by said signal source to the corresponding igniter to a low value which is insufficient to fire the round of ammunition, each signal circuit including indicating means for indicating the presence or absence of the signal current between said signal source and the corresponding igniter, each switching device including means operative in said firing condition for connecting the corresponding igniter circuit to said firing voltage source for firing the round of ammunition.

2. An ammunition firing system according to claim 1, in which each of said switching devices comprises a switch having a signal position and a firing position, said switch having a first fixed contact connected to the corresponding signal circuit, a second fixed contact connected to said firing voltage source, and a movable contact connected to the corresponding igniter circuit, said movable contact being movable between said first fixed contact in said signal position and said second fixed contact in said firing position of said switch.

3. An ammunition firing system according to claim 1, in which each current limiting impedance includes a current limiting resistance for limiting the signal current in the corresponding igniter to a low value which is insufficient to fire the corresponding round of ammunition.

4. An ammunition firing system according to claim 1, in which the electrical resistance of each igniter is such that a predetermined minimum threshold current through said igniter is required to fire the ammunition, said signal source having a predetermined signal voltage, each current limiting impedance including a current limiting resistance for limiting the igniter current produced by said signal voltage through said igniter resistance to a value substantially less than said threshold current.

5. An ammunition firing system according to claim 1, in which each of said indicating means includes a voltage indicator for indicating the voltage drop across the corresponding igniter circuit.

6. An ammunition firing system according to claim 1, in which each igniter circuit includes an igniter lead connected to one side of the corresponding igniter, and grounding means for connecting the other side of said igniter to a common ground, each of said switching devices being connected to the corresponding igniter lead, said firing voltage source having an ungrounded side and a ground return connection to said common ground, each of said switching devices being connected to the ungrounded side of said firing voltage source, said signal source having an ungrounded side and a ground return connection to the common ground, each signal circuit being connected between the corresponding switching device and the ungrounded side of said signal source.

7. An ammunition firing system, comprising a plurality of rounds of ammunition, each of said rounds having an electrically operable igniter with a predetermined electrical resistance, a plurality of igniter circuits connected to the respective igniters, each igniter circuit including an igniter lead connected to one side of the corresponding igniter and grounding means for connecting the other side of said igniter to a common ground, a firing voltage source, a signal voltage source, said firing voltage source and said signal voltage source having respective ungrounded sides and ground return connections to the common ground, a plurality of switches connected to the respective igniter leads, each of said switches being independently operable between a signal position and a firing position, and a plurality of signal circuits connected between said signal voltage source and the respective switches, each switch including a first contact connected to the corresponding signal circuit, a second contact connected to the ungrounded side of said firing voltage source, and a third contact connected to the corresponding igniter lead and alternatively engagable with said first contact in said signal position and said second contact in said firing position, each signal circuit including a current limiting resistance connected between the ungrounded side of said signal voltage source and the first contact of the corresponding switch, each igniter having an electrical resistance such that a predetermined minimum threshold current through said igniter is required to fire the ammunition, each current limiting resistance having a sufficiently high value to limit the signal current through the corresponding igniter to a value substantially less than said threshold value, and indicating means for indicating the presence or absence of the signal current in each of said signal circuits to indicate the presence or absence of the igniter in each of said igniter circuits.

8. An ammunition firing system according to claim 7, in which said indicating means include means for indicating the voltage between the first contact of each switch and ground with said switch in said signal position, such voltage being substantially lower when the igniter is present in the corresponding igniter circuit than when the igniter is absent.

* * * * *